United States Patent [19]

Meyer et al.

[11] Patent Number: 4,955,413

[45] Date of Patent: Sep. 11, 1990

[54] A1 ALLOY PRODUCT CONTAINING LI, RESISTANCE TO CORROSION UNDER STRESS, AND PROCESS TO OBTAIN SAID PRODUCT

[75] Inventors: Philippe Meyer, Voiron; Bruno Dubost, St. Egréve, both of France

[73] Assignee: Cegedur Societe de Transformation de l'Aluminum Pechiney, Paris, France

[21] Appl. No.: 156,595

[22] Filed: Feb. 17, 1988

[30] Foreign Application Priority Data

Feb. 18, 1987 [FR] France ..... 87 02719
Jan. 20, 1988 [FR] France ..... 88 01005

[51] Int. Cl.[5] ..... C22F 1/04

[52] U.S. Cl. ..... 148/12.7 A; 148/159; 148/415; 148/416; 148/417; 148/418

[58] Field of Search ..... 148/11.5 A, 12.7 A, 148/159, 415–418

[56] References Cited

U.S. PATENT DOCUMENTS 4,526,630 7/1985 Field ..... 148/159

*Primary Examiner*—R. Dean

*Attorney, Agent, or Firm*—Dennison, Meserole, Pollack & Scheiner

[57] ABSTRACT

The invention concerns an Al alloy product containing lithium, with great specific mechanical strength and high tolerance to damage, particularly resistance to corrosion under stress in processed state (quenched-tempered), particularly in recrystallized state, and a process to obtain said product.

The products according to the invention present a specific microstructure, with numerous rather coarse precipitates of intermetallic phases which are rich in Al, Cu, Li, Mg and optionally also Zn, of which the volume fraction is between 0.6 and 4%. A differential enthalpic analysis allows verification that the product has been processed according to the method which is claimed.

This method consists of applying the following thermal treatments to the alloy:

an optional heat maintenance stage in the course of the manufacture (for wrought alloys) or before placement in solution (for the cast alloys) at a temperature of between 490° and 250° C. for 1 to 48 hours.

a placement in solution between 460° C. and $T_M$ (°C.) $=474+18.2$ (%2i) 2% Cu (%Cu$-1.7)+$% Mg ($-17.6+3.6$% Li $+4.3$% Cu)$-3$% Zn.

The recrystallized products which are thus treated are not sensitive to corrosion under stress in the long transverse direction for the flat products and also present a good fatigue resistance.

The products are intended essentially for use in aeronautical and space industries.

18 Claims, 5 Drawing Sheets

500 μm

A1 ALLOY PRODUCT CONTAINING LI, RESISTANCE TO CORROSION UNDER STRESS, AND PROCESS TO OBTAIN SAID PRODUCT

The present invention concerns an Al alloy product containing lithium with great specific mechanical strength and high tolerance to damage, particularly resistant to corrosion under stress when it has been treated (quenched and tempered), especially in the recrystallized state, and a process to obtain said product.

One essential objective for metallurgical semi-finished products intended for use in aeronautics or space is obtaining alloys possessing a high resistance to corrosion under stress.

Aluminum-lithium alloys which besides their other properties have excellent mechanical, toughness, ductility or fatigue resistance (see Ph. MEYER, B. DUBOST—AlLiAlloys III—Proceeding of the Third International Conference Sponsored by the Institute of Metals. Oxford 8–11 Jul. 1985—Baker Gregson Harris Peel London—1986) may present insufficient corrosion resistance under stress when they are recrystallized, even when rolled in thin sheets.

This insufficiency is such as to limit their range of use; for instance the simple placement of rivets with a strong thrust, as in the case of conventional corrosion-sensitive alloys under stress (CST) (see Kaneko Siemenz—Corrosion Thresholds for interference fit fasteners and cold worked holes—Stress Corosion new Approaches AST-M—STP 610, 1976, pp. 252–266), can lead to cracks due to the corrosion under stresses, induced by the residual stresses resulting from the riveting.

The products according to the invention possess a particular microstructure comprising numerous and rather large precipitates of intermetallic phases which are rich in the Al, Cu, Li, Mg and perhaps Zn elements, either in addition to the solid solution, or else as a solid solution obtained by placing the products in solution at low temperature.

The corresponding process consists essentially of placing the alloy in solution at low temperature, generally in incomplete solution, with the other manufacturing parameters, particularly the aging remaining unchanged from traditional practice.

The invention is used for all aluminum base alloys containing lithium, obtained by casting, rapid solidification, ingot metallurgy or any other production technique.

The invention is applied particularly to Al base alloys of which the principle elements are the following (in weight %):

Li: 1.0 to 4.2%
Cu: 0 to 5.5%
Mg: 0 to 7.0%
Zn: 0 to 15.0%
with the following minor elements:
Zr: 0 to 0.2
Mn: 0 to 1
Cr: 0 to 0.3
Nb: 0 to 0.2
Ni: 0 to 0.5
Fe: 0 to 0.5
Si: 0 to 0.5
Other elements: up to 0.05 each
Remainder Al.

Preferably, one should have: $\% Zn/30 + \% Mg/18 + \% Li/4.2 + \% Cu/7 < 1$.

The products according to the invention may preferably contain (in % by weight) from 1.7 to 2.5 Li—0.8 to 3% Mg—1.0 to 3.5% Cu—up to 2% Zn, the remainder being constituted by aluminum, secondary elements such as Zr (0 to 0.20%), Mn, Cr, Ti and impurities of which the total quantity is below or equal to 1% and are treated in a specific manner. They present a microstructure which is particularly resistant to corrosion under stress and which comprises, in addition to the solid solution, numerous and sufficiently coarse precipitates of intermetallic phases which are rich in the elements Al, Cu, Li, Mg and sometimes Zn if the contents of these additional elements are in conformity with the following in equality which has been determined following experimentation in metallography:

$$A > 0 \text{ where } A = \% Cu + \% Li + \% \frac{Mg}{2} + \% \frac{Zn}{3} - 2.7 - 3340 \exp\left(\frac{-5960}{273 + T}\right)$$

In this formula, % Cu, % Li, % Mg, % Zn are the weight contents and T is the temperature, expressed in degrees C. In this case these phases are of the R-$Al_5Cu$ $(Li, Mg)_3$ type and of the T 2-$Al_6Cu$ $(Li, Mg)_3$ type, in the 8090 and 2091 alloys according to Aluminium Association designation.

The metallographic and structural features of these phases and their lattice spacings in X ray diffraction are analogous to those given in the article by H. K. HARDY and J. M. SILCOK in the Al-Li-Cu system free of magnesium (Journal of the Institute of Metals, 1955–56, Vol 84, p. 423–425).

The volume fraction of these particles increases with the total content of Li, Cu, Mg and Zn and is proportionally higher with lowering of the temperature of placement in solution, according to the invention. As a result of metallographic and structural analysis, the applicant has established that the volume fraction of the particles, in % age, is $fv = k.A$ if A is greater than 0 with $2.0 \leqq k \leqq 4.0$. This volume fraction must generally be greater than 0.6% and preferably between 1 and 4%, particularly in the 2091 alloy. Below 0.6%, insufficient resistance to corrosion under stress on recrystallized products can be a problem; above 4%, the mechanical strength and ductility characteristics become too weak.

The largest dimension of the largest particles exceeds 5 μm and preferably exceeds 10 μm.

This structure can be controlled by a differential thermal analysis or enthalpic differential analysis (DSC: Differential Scanning Calorimetry), the plotting (thermogram) then presenting the following characteristics in solution and incipient fusion temperatures field in the course of a rise of the temperature of a sample programmed at a velocity of 1 to 20 degrees C./minute:

an apparent plateau or pseudo-plateau extending between the temperature of dissolution being carried out on the alloy and the beginning fusion temperature of the alloy.

This pseudo-plateau for which the thermogram which is obtained evolves essentially like the base line of the differential enthalpic analysis apparatus (determined with 2 identical inert samples or else with neither sample nor reference), is then proportionally longer as the temperature of dissolution is lower. Moreover, during the test it appeared that the beginning temperature of this plateau coincides in practice with the temperature of dissolution according to the invention or else the reheat temperature, if the alloy is not placed in solution, this in the case wherein the Differential Enthalpic Analysis is carried out following these thermal operations. Tempering does not greatly modify the thermogram in these high temperatures. This method locates with certainty, the temperature of dissolution, or even the temperature of reheating, in practice. It thus provides on the product treated to the final state (placed in solution, quenched and possibly cold hardened and tempered) the physical identification of the treatment according to the invention.

This pseudo-plateau is followed by a wide endothermic peak representing the return into solution of the small precipitates of equilibrium phase formed during the temperature rise of the sample in the stage preceding that of the temperatures of dissolution carried out on the alloy.

An endothermic fusion peak around 532° to 550° C., corresponding to incipient melting of the AlCuLiMg phase (R or T 2 in preferential composition) in the Al matrix (according to the composition of the alloy) proportionally greater in peak surface (i.e. in the heat, absorbed for the fusion) as the phase volume fraction out of solution T 2 or R is larger.

Therefore, because of this, the surface area of this peak is proportionally greater as the temperature of dissolution according to the invention, before the thermal analysis, is low and is lower than the temperature of dissolution usually employed on the alloy. An alloy free of phases out of solution T 2 or R, i.e. an alloy of composition such as $A<0$ having been subjected beforehand to placement of the large particles of phases T 2 to R in complete solution at high temperature according to the procedure normally known to a person in the art does not present such a peak around 532°-550° C.

The method according to the invention consists of placement in solution carried out in a range of temperatures $T_{MS}$ below the traditional temperature of dissolution which the person in the art considers to be the highest possible in order to obtain the maximum mechanical strength, as a result of increasing placement in solution of hardening elements.

$T_{MS}$ must be below $T_M$ (in ° C.)=474+18.2% Li—2% Cu (% Cu—1.7)+% Mg (−17.6+3.6% Li+4.3% Cu)−3% Zn, wherein % Li, % Cu, % Mg, % Zn are the weight percentages of the cited alloy elements, but must remain above or equal to 460° C. and preferably 480° C.

The duration of the placement in solution can be the same as that traditionally carried out at high temperature on the aluminum-lithium alloys according to the prior art, generally from 10 minutes to 7 hours according to the products (thin sheet to thick forged article).

If the placement in solution is carried out at too high a temperature, the result is a very appreciable loss of the corrosion resistance under stress; on the other hand, if it is carried out at too low a temperature, the mechanical strength is insufficient.

The placement in solution is followed by quenching under the customary conditions.

The tempering treatment is not modified in relation to traditional practice for aluminum alloys containing lithium.

The placement in solution is preferably preceded in the course of the manufacture by an optional heat maintenance stage (with or without plastic deformation).

This heat maintenance stage is preferably carried out in a temperature range between 490° and 250° C., and more particularly between 450° and 350° C., for a time of between 1 hour and 48 hours, preferably between 6 and 24 hours.

However, the maximum temperature of this heat maintenance stage must be below or equal to that of the subsequent placement in solution.

This heat maintenance stage can be optionally multileveled on condition that the last plateau be at the temperature level of the invention.

It is preferably applied following the hot deformation phase for wrought alloys.

It can optionally be followed by a cold deformation.

If the alloy is cold deformed and if this deformation requires intermediate heating, the last process step will be carried out under the conditions defined above.

The velocity of cooling following the heat maintenance stage must be greater than 10° C./hour and preferably greater than 25° C./hour. This velocity is the average velocity between the heat maintenance stage temperature and 100° C., the velocity of cooling below 100° C. not being critical.

The cooling can be carried out in furnace, under air current, in calm air, in water, or by any other technique allowing the desired cooling velocities to be obtained.

If the heat maintenance stage is carried out at too high a temperature, the corrosion resistance under stress is greatly diminished. If the heat maintenance stage is carried out at too low temperature, difficulties arise for the subsequent cold deformation or even a diminution of the corrosion resistance under stress.

The invention will be understood from the following examples, which are illustrated by FIGS. 1 to 7.

EXAMPLE 1

Two 1.6 mm thick plates of the following composition (in % by weight):

Li: 2.07—Cu: 2.15—Mg: 1.53—Zr: 0.10—Ti: 0.03 Fe: 0.04 —Si: 0.03 remainder Al were treated in the following manner:

anneal 1 hour 450° C. +12 hours 400° C. followed by placement in solution (according to the invention) or 530° C., quenched in cold water, stretched to 2% and aged for 12 hours at 135° C.

Figure 1:
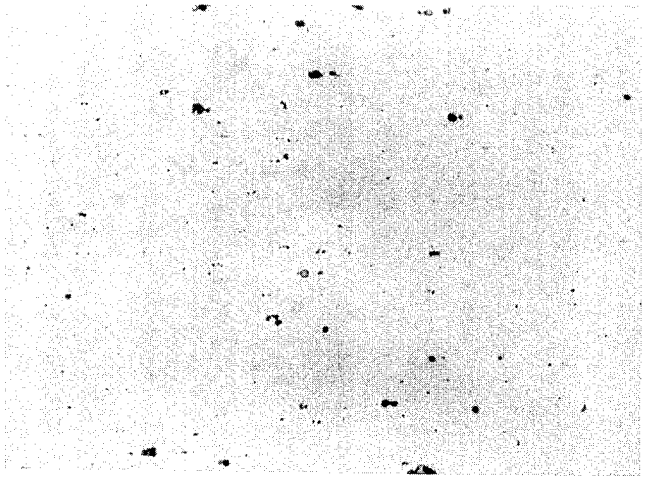
FIG. 1 shows the optical micrograph in the long short transverse plane of an alloy treated outside the invention.
Figure 2:
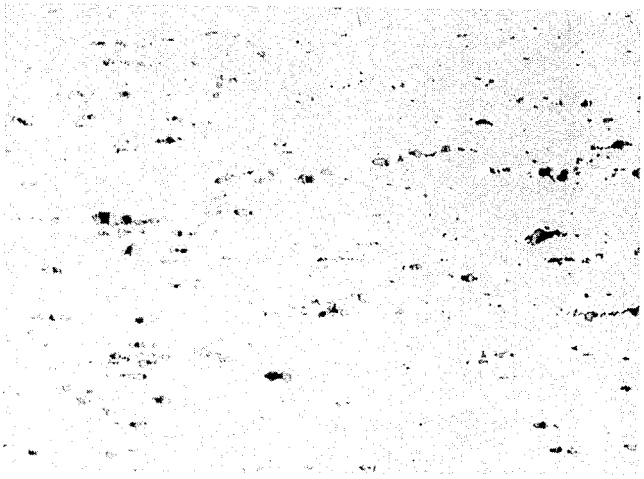
FIG. 2 represents the micrograph in the long short transverse short plane of an alloy treated according to the invention.
Figure 3:
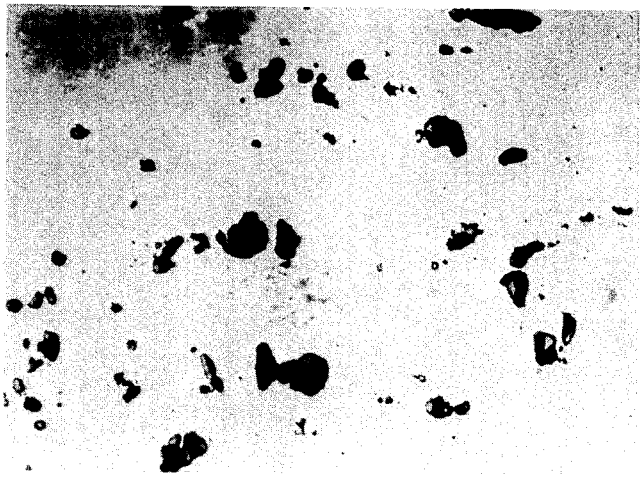
FIG. 3 represents the long-long transverse plane of an alloy treated according to the invention.

The microstructures obtained are shown in FIG. 1 which concerns the placement in solution at 530° C. and in FIGS. 2 and 3 which concern the placement in solution at 500° C. The coarse particles, obviously larger than 5 μm, are essentially constituted of R-$Al_5Cu$ (Li, Mg)$_3$ phase, out of solution (point verified by quantitative analysis by Castaing electronic microwave and by diffraction of the X-rays according to the Seeman-Bohlin method).

Their average surface area fractions on polished sections (equal to the volume fraction in the solid sample), measured by quantitative image analysis on the IBAS KONTRON apparatus is 0.53% after placement in solution at 530° C. (k≃2.9) and 2.3% after placement in solution at 500° C. (k≃2.7) with a precision of approximately ±10% of this average value.

EXAMPLE 2

The same alloy as above (alloy 2091) was placed in solution at various temperatures of between 490° C. and 535° C. after annealing for 1 hour at 400° C. and cold rolling, quenching with water and tempering for 12 hours at 135° C., before submitting to differential thermal analysis on a DUPONT de NEMOURS DSC 910 apparatus by a DSC 990 program in the following conditions: samples and reference sample (refined aluminum) machined in the form of 5 mm diameter disks of 1 mm thickness dry nitrogen sweeping in the cell speed of temperature rise of 5° C./minute between 400° and 590° C.

Figure 4:
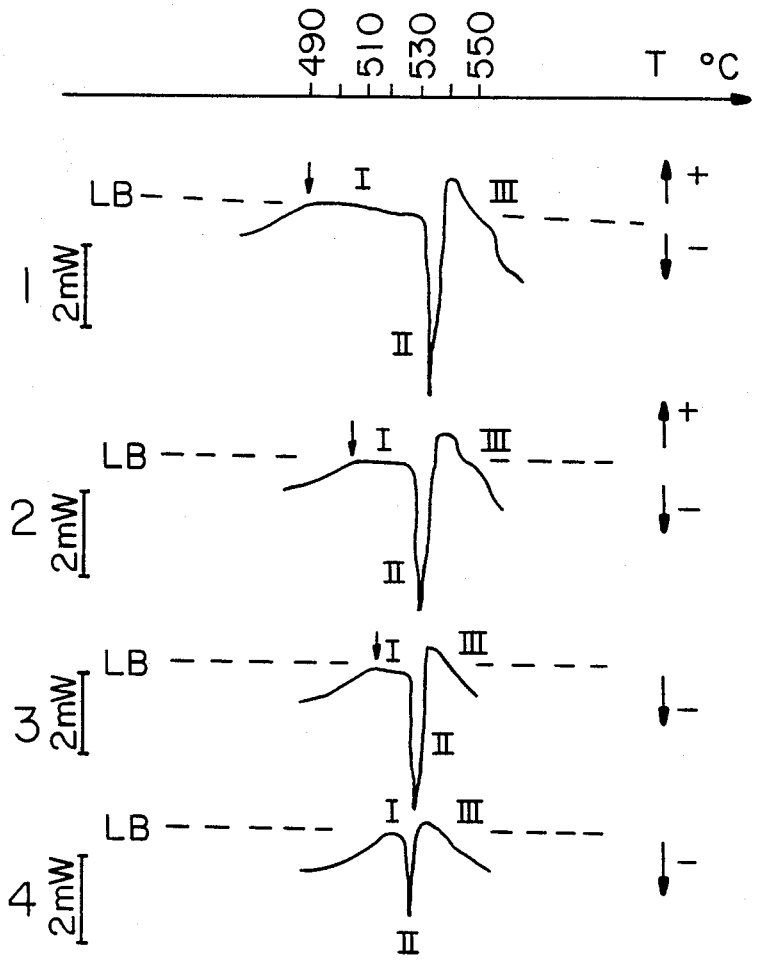
FIG. 4 represents various thermograms of a 2091 alloy placed in solution at various temperatures (Example 2).

The thermograms which are obtained are shown in FIG. 4. In these thermograms the abscissa represents the temperature in ° C. and the ordinate represents the power (in mW) released or absorbed respectively in the exothermic (+) or endothermic (−) direction The base line of the apparatus (LB) is shown in broken lines.

Curve (1) corresponds to placement in solution at 490° C.

Curve (2) corresponds to placement in solution at 510° C.

Curve (3) corresponds to placement in solution at 520° C.

Curve (4) corresponds to placement in solution at 530° C.

It is to be seen on each thermogram that the beginning temperature of the detectable pseudo-plateau (I)—essentially rectilinear part which is very slightly endothermic in relation the the base line of the apparatus determined beforehand—with the precision of measurement and the determination of the phase transformation temperatures by intersection of the tangents on the thermogram, corresponds to the effective temperature of placement in solution according to the invention, and this at a closer than 3° C. correspondence.

The narrow beginning fusion peak (II) of the eutectic constituents is also to be noted, which begins at about 535° C. and ends just before the equilibrium fusion of the alloy (solidus). This is marked by a very profound and progressive endothermic peak (III).

The incipient (endothermic) fusion peak appears, according to thermal analysis, much more profound in the alloys treated according to the invention, than in the alloy treated at 530° C. according to the traditional placement in solution.

The combination of this differential thermal analysis method and the metallographic analysis of Example 1 then allows for a reliable and new manner of identification of the products manufactured according to the invention subject of this application.

EXAMPLE 3

A 2091 alloy of the following composition by weight: 1.95% Li —2.10% Cu—1.5% Mg—0.08% Zr—0.04% Fe—0.04% Si—remainder aluminum is cast in plates of 800×300 square mm section, homogenized for 24 hours at 527° C., scalped, then hot rolled at between 470° and 380° C. to obtain 3.6 mm thickness and is wound in a coil. It is then subjected to a heat maintenance stage according to the invention for 1 hour at 450° C. followed by 12 hours at 400° C. (with cooling in furnace between the two stages). The cooling following the heat maintenance stage is effected at a velocity close to 35°/hour down to the temperature of 100° C.

After heat maintenance stage, the plates are cold rolled down to 1.6 mm. A portion of the thin plates thus manufactured is then placed in solution according to the invention (case A): 20 minutes at 500° C. ±2° C., quenched with cold water, straightened out and stretched to 2%, and finally tempered for 12 hours at 135° C.

Another portion of the plates is placed in solution outside the parameters of the invention (case B) for 20 minutes at 528° C.±2° C. and then subjected to the same finishing process as described in case A above. In this case: $T_M$=505.5° C.

The structure of the alloy is recrystallized into fine and equiaxial grains (average size: 20 μm).

The properties obtained in the two instances in the long direction (L), long transverse (TL) and at 60° from the rolling direction (60°/L) are shown in Table I.

It will be noted that the treatment of the invention provides a very remarkable improvement of the resistance to the CST in the rolling plane while still preserving good mechanical properties.

Figure 5:
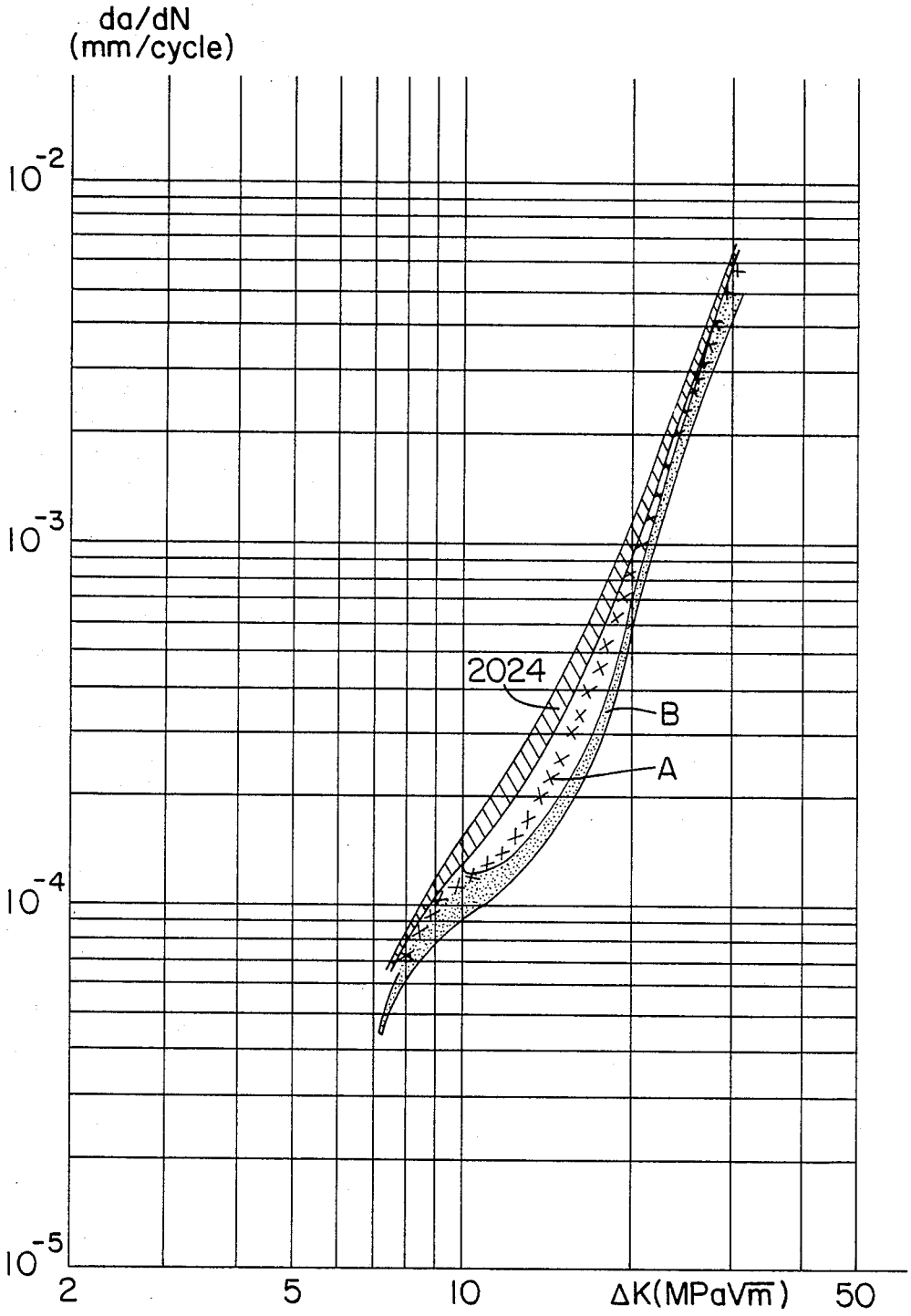
FIG. 5 represents the evolution curves of the velocity of propagation (da/dn) of a fatigue crack in undulating traction: $\sigma=90\pm40$ MPa as a function of the $\Delta K$ in the LT and TL directions, for the alloys according to the invention (case A), outside the invention (case B), corresponding to Example 3, and for the reference alloy (2024).

The results of propagation of cracks shown in FIG. 5 confirm the high level of fatigue properties of the alloy processed according to the invention, which are superior to those of the reference alloy: 2024.

EXAMPLE 4

A 2091 alloy of the following composition: 2.2% Li—2.3% Cu —1.6% Mg—Zr 0.10%—Fe 0.04%—Si 0.03%, the remainder aluminum, is cast in ingots of 100×300 square mm section, homogenized for 24 hours at 527° C., scalped, hot rolled, between 470° and 380° C. to 3.6 mm. A portion of the plates (marked C) is then subjected to heat maintenance stage according to the invention: 24 hours at 415° C., cooling by quenching in cold water.

Plates D: they are subjected to a heat maintenance stage outside the invention: 24 hours 415° C. with a cooling of 8° C./hour between 415° and 100° C.

The two types of plates are then cold rolled to 1.6 mm. The plates are placed in solution according to the invention for 20 minutes at 510° C., quenched in cold water, straightened out and stretched, then tempered for 12 hours at 135° C.

In this case, $T_M$=511.6° C.

The properties of corrosion under stress and measured mechanical strength are shown in Table II.

EXAMPLE 5

A 2091 alloy of the following composition (in weight): 2.0% Li —1.8% Cu—1.4% Mg—0.12% Zr—0.06% Fe—0.04% Si is cast in billets of 50 mm diameter (heated by induction; extrusion at 430° C.).

This bar is worked in 500 mm lengths; these lengths have been heated and stamped in a plurality of passes between 490° and 400° C. Before the last stamping pass, the pieces are subjected to a heat maintenance stage according to the invention for 6 hours at 450° C. and deformed at this temperature. They are then subjected to a cooling at velocity above 100° C./hour down to 100° C. according to the invention.

Figure 6:
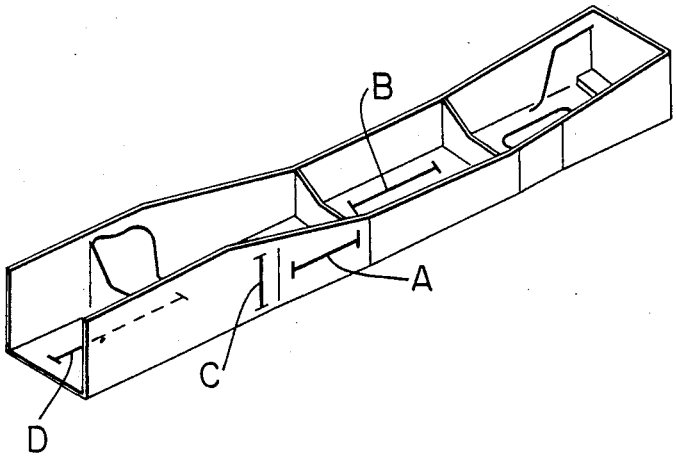
FIG. 6 represents a stamped out article treated according to the invention and the relative positions of the traction and corrosion test pieces under stress (Example 5).

The articles are then placed in solution at 503° C. ±2° C. for 4 hours according to the invention, quenched in cold water and tempered for 24 hours at 190° C. (in this case, $T_M$=506.3° C.). These pieces (see FIG. 6) are characterized by their performance under traction and in corrosion under stress.

The traction test samples (sites A, B and C) are removed from the ribbing intersections. To the contrary, the corrosion under stress samples are cut through the uprights of ribs (site D).

The results are shown in Table III.

EXAMPLE 6

An alloy of the following composition (in weight): 2.5% Li—1.2% Cu—1.0% Mg—0.06% Zr—1.5% Zn—0.06% Fe—0.04% Si is cast in plates of 300×100 mm square section, homogenized for 24 hours at 535° C. (with rise of homogenization temperature at the rate of 25° C./hour starting from 500° C.). It is thereafter scalped, heated to 490° C., hot rolled between 480° and 300° C. to 3.6 mm. The rough hot rolling product which is thus obtained is then subjected to heat maintenance stage for 1 hour at 450° C., cooled by quenching in cold water and cold rolled from 3.6 to 1.2 mm.

The plates which are thus obtained are placed in solution in a furnace in a salt bath for 20 minutes at 485° C., quenched with cold water, stretched to 1.5% and tempered for 12 hours at 190° C. (in this case, $T_M$=512.7° C.).

Figure 7:
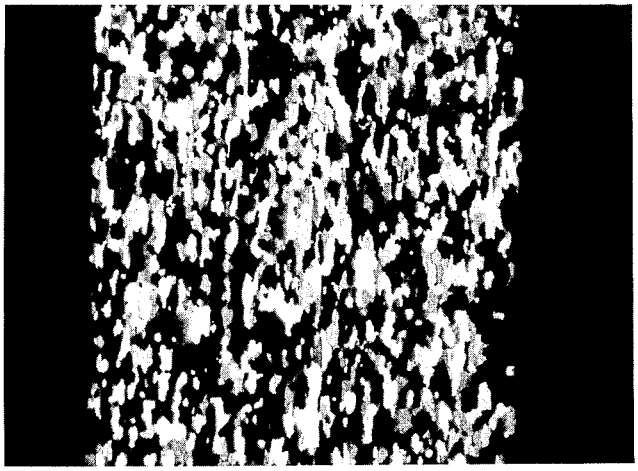
FIG. 7 represents the structure of the alloy processed according to the invention corresponding to Example 6.

The structure which is obtained is recrystallized (see FIG. 7).

The properties which are obtained are shown in Table IV.

TABLE 1

| A - INVENTION | | | | B - OTHER THAN INVENTION | | | |
|---|---|---|---|---|---|---|---|
| Direction | RO,2 (MPa) | Rm (MPa) | A % | Direction | RO,2 (MPa) | Rm (MPa) | A % |
| L | 315 | 435 | 14.5 | L | 345 | 440 | 19 |
| TL | 325 | 450 | 13.5 | TL | 330 | 455 | 17 |
| 60°/L | 290 | 425 | 18.0 | 60°/L | 290 | 430 | 23 |
| | Kc (MPa$\sqrt{m}$) | | | | Kc (MPa$\sqrt{m}$) | | |
| LT* | 140 | | | LT* | 145 | | |
| TL** | 120 | | | TL** | 125 | | |
| | CST (MPa)*** | | | | CST (MPa)*** | | |
| TL** | >200 | | | TL** | <75 | | |
| | Bending radii rc/e | | | | Bending radii rc/e | | |
| L | >2.5 | | | L | >3 | | |
| TL | >2.5 | | | TL | >3 | | |

*Lengthwise force, propagation: long transverse
**Force: long transverse direction, propagation: long direction.
***Traction tests under constant load with alternating immersion-removal for 10 minutes/50 minutes in an aqueous solution of 3.5% NaCl. Test length: 42 days.

TABLE II

| C - INVENTION | | | | D - OTHER THAN INVENTION | | | |
|---|---|---|---|---|---|---|---|
| Direction | RO,2 (MPa) | Rm (MPa) | A (%) | Direction | RO,2 (MPa) | Rm (MPa) | A % |
| TL | 346 | 459 | 13.5 | TL | 363 | 470 | 11.5 |
| | CST under 200 MPa* | | | | CST under 200 MPa* | | |
| TL | 6 NR** a 90 days | | | NL | 6 breaks$_3$/6: 23,24,25,26 27, 27 days | | |

*Test carried out under traction with constant load in alternating immersion-removal (10 minutes/50 minutes) in an aqueous solution of 3.5% NaCl.
**NR: no break.

TABLE III

| SAMPLING | RO,2 (MPa) | Rm (MPa) | A % |
|---|---|---|---|
| A | 443 | 503 | 6.0 |
| B | 458 | 544 | 9.0 |
| C | 413 | 461 | 4.5 |
| | CST under 140 MPa* 3 no-breaks at 30 days | | |

*Bending test under constant load with alternating immersion-removal (10 minutes/50 minutes) in an aqueous solution with 3.5% NaCl.

TABLE IV

| DIRECTION | R O,2 | Rm | A % |
|---|---|---|---|
| Lengthwise | 347 | 414 | 7.6 |
| Long transverse | 350 | 441 | 7.3 |
| 60°/L | 310 | 418 | 9.4 |
| | CST under 200 MPa* 3 no-breaks at 30 days | | |

*Bending under constant load in alternating immersion-removal in an aqueous solution with 3.5% NaCl.

We claim:

1. Aluminum base alloy product consisting essentially of, by weight, from 1 to 4.2% Li, up to 5.5% Cu, up to 7% Mg, up to 15% Zn, up to 0.2% Zr, up to 1% Mn, up to 0.3% Cr, up to 0.2% Nb, up to 0.5% Ni, up to 0.5% Fe, up to 0.5% Si, and other elements: up to 0.05% of each, the remainder Al, said product being resistant to stress corrosion, and containing, after solution anneal at a temperature $T_M$° C., a positive volume % of precipitates equal to K.A, where $A=\%Cu+\%Li+(\%Mg/2)+(\%Zn/3)-2.7-3340 \exp(-5960)/(273+T)$ with $A>0$ and $2 \leqq K \leqq 4$, wherein T is the actual temperature of the solution anneal in ° C.

2. Product as in claim 1 wherein the pseudo-plateau which is visible on the thermograms is followed by a narrow peak of fusion beginning between 532° and 550° C.

3. Product as in claim 1 or 2, wherein $$\frac{\%\ Zn}{30}+\frac{\%\ Mg}{18}+\frac{\%\ Li}{4.2}+\frac{\%\ Cu}{7}<1$$

4. Product as in claim 1 wherein the dimensions of the largest precipitates exceed 5 μm.

5. Product as in claim 1 or 4 wherein the dimensions of the largest precipitates exceed 10 μm.

6. Product as in claim 1, wherein the precipitates comprise phase R or phase T2 which comprise Al, Cu, Li and Mg and wherein the volume fraction of said particles is greater than 0.6%.

7. Product as in claim 1 wherein the volume fraction of the precipitates is between 1 and 4%.

8. Product as in claim 1 wherein its structure is recrystallized.

9. Product as in claim 1 wherein its composition is that of the 2091 alloy as is defined by the Aluminium Association.

10. Process for the manufacture of Al alloys containing Li and optionally Cu, Mg, Zn, Zr, Mn, Cr, Nb, Ni, Fe and Si, allowing them to be densensitized to corrosion under stress comprising the steps of hot shaping of a cast or wrought product, optionally cold-working, incompletely solution annealing, quenching, optionally controlled cold-working and tempering, wherein the incomplete solution annealing is carried out in a temperature range of between 460° C. and $T_M$ (° C.)=474+18.2(% Li)—2(% Cu) (% Cu—1.7)+(% Mg) (−17.6+3.6(% Li)+4.3(% Cu))−3(% Zn).

11. Process as in claim 10, wherein the solution annealing is preceded, in a prior manufacturing step, by a heat maintenance stage carried out between 250° C. and 490° C. followed by a cooling step down to a temperature of 100° C., at an average rate of greater than 10° C./hour.

12. Process as in claim 11, wherein the heat maintenance stage is carried out between 450° and 350° C.

13. Process as in claim 11 or 12, wherein the duration of the heat maintenance stage is between 1 and 48 hours.

14. Process as in claim 11 or 12, wherein the temperature of the heat maintenance stage is less than or equal to the temperature of solution annealing.

15. Process as in claim 11, wherein said average cooling rate is 25° C. per hour.

16. Process as in claim 11, wherein said heat maintenance stage is carried out with simultaneous plastic deformation.

17. Process as in claim 13, wherein the duration of said heat maintenance stage is between 6 and 24 hours.

18. Product as in claim 1, wherein the thermograms obtained by differential enthalpic analysis of the product present a pseudo-plateau, beginning at the effective point of solution annealing, which is less than or equal to:

$T_M$(° C.)=474+18.2% Li−2% Cu (% Cu—1.7) +% Mg (3.6% Li+4.3% Cu−17.6)−3% Zn and terminating at the beginning of the fusion temperatures for the alloy.

* * * * *